US011398669B2

(12) United States Patent
Ma et al.

(10) Patent No.: US 11,398,669 B2
(45) **Date of Patent: *Jul. 26, 2022**

(54) ANTENNA ARRANGEMENT FOR AN ELECTRONIC DEVICE

(71) Applicant: MICROSOFT TECHNOLOGY LICENSING, LLC, Redmond, WA (US)

(72) Inventors: Guozhong Ma, Beijing (CN); Anrong Zhang, Beijing (CN); Jie Zhang, Beijing (CN); Wei Wang, Beijing (CN)

(73) Assignee: MICROSOFT TECHNOLOGY LICENSING, LLC, Redmond, WA (US)

( * ) Notice: Subject to any disclaimer, the term of this patent is extended or adjusted under 35 U.S.C. 154(b) by 167 days.

This patent is subject to a terminal disclaimer.

(21) Appl. No.: 16/696,445

(22) Filed: Nov. 26, 2019

(65) Prior Publication Data

US 2020/0099126 A1 Mar. 26, 2020

Related U.S. Application Data

(63) Continuation of application No. 15/751,149, filed as application No. PCT/US2016/042698 on Jul. 18, 2016, now Pat. No. 10,498,013.

(30) Foreign Application Priority Data

Aug. 7, 2015 (CN) ..... 201510484994.3

(51) Int. Cl.

| | |
|---|---|
| ***H01Q 1/24*** | (2006.01) |
| ***H01Q 9/04*** | (2006.01) |
| ***H01Q 1/48*** | (2006.01) |
| ***H01Q 9/42*** | (2006.01) |
| ***H01Q 1/52*** | (2006.01) |

(Continued)

(52) U.S. Cl.

CPC ..... *H01Q 1/243* (2013.01); *H01Q 1/48* (2013.01); *H01Q 1/521* (2013.01); *H01Q 1/523* (2013.01);

(Continued)

(58) Field of Classification Search

None

See application file for complete search history.

(56) References Cited

U.S. PATENT DOCUMENTS 8,350,764 B2 * 1/2013 Rao ..... H01Q 21/28 343/702
8,907,853 B2 * 12/2014 Ying ..... H01Q 1/243 343/702

(Continued)

FOREIGN PATENT DOCUMENTS

CN 103579740 A 2/2014
EP 2733782 * 5/2014 ..... H01Q 1/24

OTHER PUBLICATIONS

"Second Office Action Issued in Chinese Patent Application No. 201510484994.3", dated Jan. 10, 2020, 10 Pages.

(Continued)

*Primary Examiner* — Trinh V Dinh

(74) *Attorney, Agent, or Firm* — Ray Quinney & Nebeker P.C; James Bullough

(57) ABSTRACT

The subject matter described herein relates to an antenna arrangement, an electronic device and a method for manufacturing the antenna arrangement. In one implementation, the antenna arrangement comprises a first antenna and a second antenna. The first antenna includes a first metal section connected to a first grounding point and a first initial radiator for feeding first radiations to the first metal section. The second antenna includes a second metal section connected to a second grounding point and a second initial radiator for feeding second radiations to the second metal (Continued)

section. The first and second metal sections are integral parts of a housing of the electronic device and separated by an opening. The second metal section is further connected to a third grounding point to provide isolation between the two antennae. Thus, a pair of antennae with a good antenna performance can be built with the same one structure.

20 Claims, 7 Drawing Sheets

(51) Int. Cl.
*H01Q 21/28* (2006.01)
*H01Q 21/00* (2006.01)

(52) U.S. Cl.
CPC ..... *H01Q 9/42* (2013.01); *H01Q 21/0075* (2013.01); *H01Q 21/0087* (2013.01); *H01Q 21/28* (2013.01)

(56) References Cited

U.S. PATENT DOCUMENTS

2011/0215971 A1* 9/2011 Rao ..... H01Q 1/243 343/702
2014/0139379 A1* 5/2014 Bolin ..... H01Q 1/243 343/702
2016/0204499 A1* 7/2016 Toh ..... H01Q 1/521 343/702
2016/0233574 A1* 8/2016 Xiong ..... H01Q 1/2258
2018/0375971 A1* 12/2018 Sun ..... H01Q 1/243

OTHER PUBLICATIONS

"Third Office Action Issued in Chinese Patent Application No. 201510484994.3", dated Jun. 9, 2020, 10 Pages.

* cited by examiner

ANTENNA ARRANGEMENT FOR AN ELECTRONIC DEVICE

CROSS-REFERENCE TO RELATED APPLICATIONS

This application is a Continuation of U.S. patent application Ser. No. 15/751,149, filed Feb. 7, 2018, which is a U.S. Nationalization of International Application No. PCT/US2016/042698, filed Jul. 18, 2016, which claims the benefit of Chinese Patent App. No. 201510484994.3, filed Aug. 7, 2015, the disclosures of which are hereby incorporated by reference in their entireties.

BACKGROUND

An electronic device, such as a mobile phone, may include antenna arrangement to enable the electronic device to communicate with another device wirelessly. In a conventional antenna design, the antenna arrangement is provided within a housing of the electronic device. The antenna arrangement usually employs a Planar Inverted-F Antenna (PIFA) or a monopole antenna. However, the PIFA has drawbacks such as high demands on area and thickness, poor performance, etc.; and at the same time, the monopole antenna also suffers from poor performance since a big metal clearance is required.

Recently, a new antenna arrangement using metal rings as radiators becomes popular in wireless communication applications. Different from the conventional antenna design, the antenna arrangement uses a part of a metal frame of a wireless electronic device as antenna radiators. Generally, the antenna radiators require some slot cuttings and a direct feeding element which bridges a metal ring and radio frequency (RF) chipset. Such an antenna arrangement could provide an antenna design with a compact structure. However, the antenna performance could be substantially degraded during a call due to unintentional covering of the slots. At the same time, in the art, demands on a multi-antenna structure, a compact antenna design and low manufacturing cost are constantly increasing.

SUMMARY

In accordance with implementations of the subject matter described herein, a new antenna arrangement for an electronic device is proposed.

The antenna arrangement comprises a first antenna and a second antenna which can function separately or collaboratively. The first antenna includes a first metal section connected to a first grounding point and a first initial radiator for feeding first radiations to the first metal section. The second antenna includes a second metal section connected to a second grounding point and a second initial radiator for feeding second radiations to the second metal metal. The first metal section and the second metal section are both integral parts of a housing of the electronic device and separated by an opening. Furthermore, the second metal section is further connected to a third grounding point to provide isolation between the first antenna and the second antenna. Besides, other implementations also provide an electronic device comprising the antenna arrangement as described hereinabove and a method of manufacturing an antenna arrangement for an electronic device. With the implementations of the subject matter described herein, a pair of antennae can be built with the same one structure and, at the same time, a good antenna performance can be achieved.

It is to be understood that this Summary is provided to introduce a selection of concepts in a simplified form. The concepts are further described below in the Detailed Description. This Summary is not intended to identify key features or essential features of the claimed subject matter, nor is it intended to be used to limit the scope of the claimed subject matter.

DETAILED DESCRIPTION

The subject matter described herein will now be discussed with reference to several example implementations. It should be understood these implementations are discussed only for the purpose of enabling those skilled persons in the art to better understand and thus implement the subject matter described herein, rather than suggesting any limitations on the scope of the subject matter.

As used herein, the term "includes" and its variants are to be read as open terms that mean "includes, but is not limited to." The term "or" is to be read as "and/or" unless the context clearly indicates otherwise. The term "based on" is to be read as "based at least in part on." The term "one implementation" and "an implementation" are to be read as "at least one implementation." The term "another implementation" is to be read as "at least one other implementation." Other definitions, explicit and implicit, may be included below.

Figure 1:
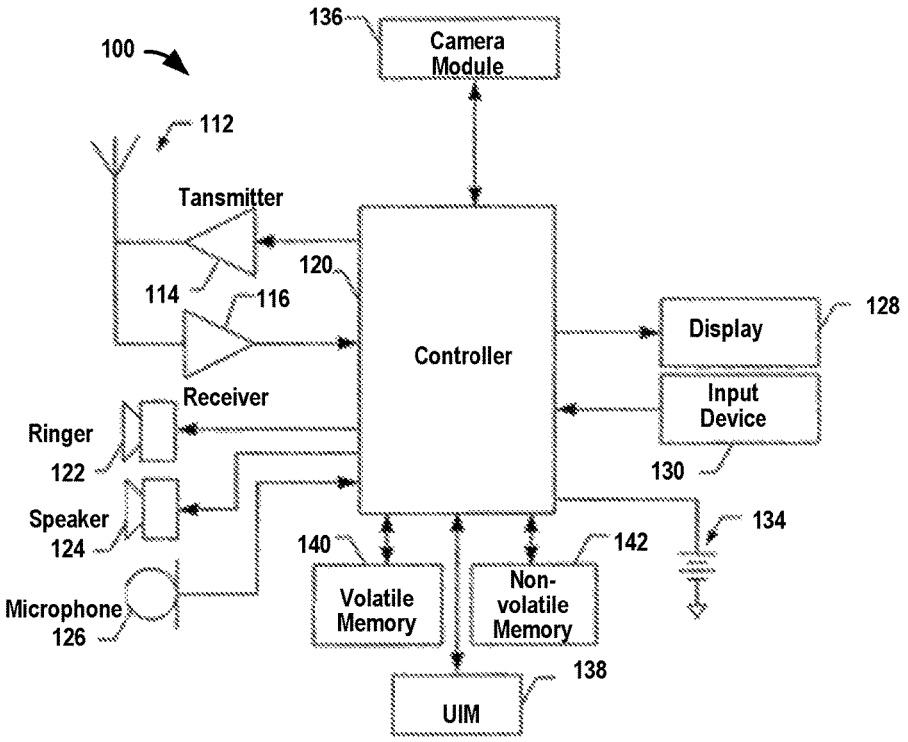
FIG. 1 schematically illustrates a block diagram of an electronic device in which one or more implementations of the subject matter described herein may be implemented.

FIG. 1 illustrates a block diagram of an electronic device 100 in accordance with an implementation of the subject matter described herein. The electronic device 100 may be a mobile device, such as a smart phone. However, it is to be understood that any other types of electronic devices with wireless communication capability may also easily adopt one implementation of the subject matter described herein, such as a portable digital assistant (PDA), a pager, a mobile computer, a mobile TV, a game apparatus, a laptop, a tablet computer, a GPS device, and other types of electronic devices with a transmitter and receiver.

The electronic device 100 comprises one or more antennas 112 which can implement the subject matter described herein and is operable to communicate with the transmitter 114 and the receiver 116. The electronic device 100 further comprises at least one controller 120. It should be understood that the controller 120 comprises circuits or logic required to implement the functions of the electronic device 100. For example, the controller 120 may comprise a digital signal processor, a microprocessor, an A/D converter, a D/A converter, and/or any other suitable circuits. The control and signal processing functions of the electronic device 100 are allocated in accordance with respective capabilities of these devices.

The electronic device 100 may further comprise a user interface, which, for example, may comprise a ringer 122, a speaker 124, a microphone 126, a display 128, and an input device 130 such as a keyboard and/or mouse, and all of the above devices are coupled to the controller 120. The electronic device 100 may further comprise a camera module 136 for capturing static and/or dynamic images.

The electronic device 100 may further comprise a battery 134, such as a vibrating battery set, for supplying power to various circuits required for operating the electronic device 100 and alternatively providing mechanical vibration as detectable output. In an implementation, the electronic device 100 may further comprise a user identification module (UIM) 138. The UIM 138 is usually a memory device with a processor built in. The UIM 138 may for example comprise a subscriber identification module (SIM), a universal integrated circuit card (UICC), a universal user identification module (USIM), or a removable user identification module (R-UIM), etc. The UIM 138 may comprise a card connection detecting apparatus.

The electronic device 100 further comprises a memory. For example, the electronic device 100 may comprise a volatile memory 140, for example, comprising a volatile random access memory (RAM) in a cache area for temporarily storing data. The electronic device 100 may further comprise another non-volatile memory 142 which may be embedded and/or movable. The non-volatile memory 142 may additionally or alternatively include for example, EEPROM and flash memory, etc. The memory 140 may store any item in the plurality of information segments and data used by the electronic device 100 so as to implement the functions of the electronic device 110. For example, the memory may contain machine-executable instructions which, when executed, cause the controller 120 to implement various method.

It should be understood that the structural block diagram in FIG. 1 is shown only for illustration purpose, without suggesting any limitations on the scope of the subject matter described herein. In some cases, some devices may be added or reduced as required.

As mentioned hereinbefore, the antenna arrangement with dual metal rings becomes popular since multiple antennae are needed in an electronic device such as a mobile device to support Long Term Evolvement (LTE). However, it also suffers from poor performance in some circumstances, especially when a user unintentionally covers the slots at which feed points are arranged. And at the same time, demands on a multi-antenna structure, a compact antenna design and low manufacturing cost are constantly increasing. In view of this, there is proposed a new antenna arrangement for an electronic device. In accordance with implementations of the subject matter described herein, two antennae are built with dual metal rings. In addition to a grounding point to which one of the metal rings is connected, the metal ring is further connected to another grounding point to provide isolation between the two antennae. Thus, a pair of antennae can be built with the same one structure and, at the same time, a good antenna performance can be achieved. Next, reference will be made to FIGS. 2 to 8 to describe the solution as provided in the subject matter described herein in further detail.

Figure 2:
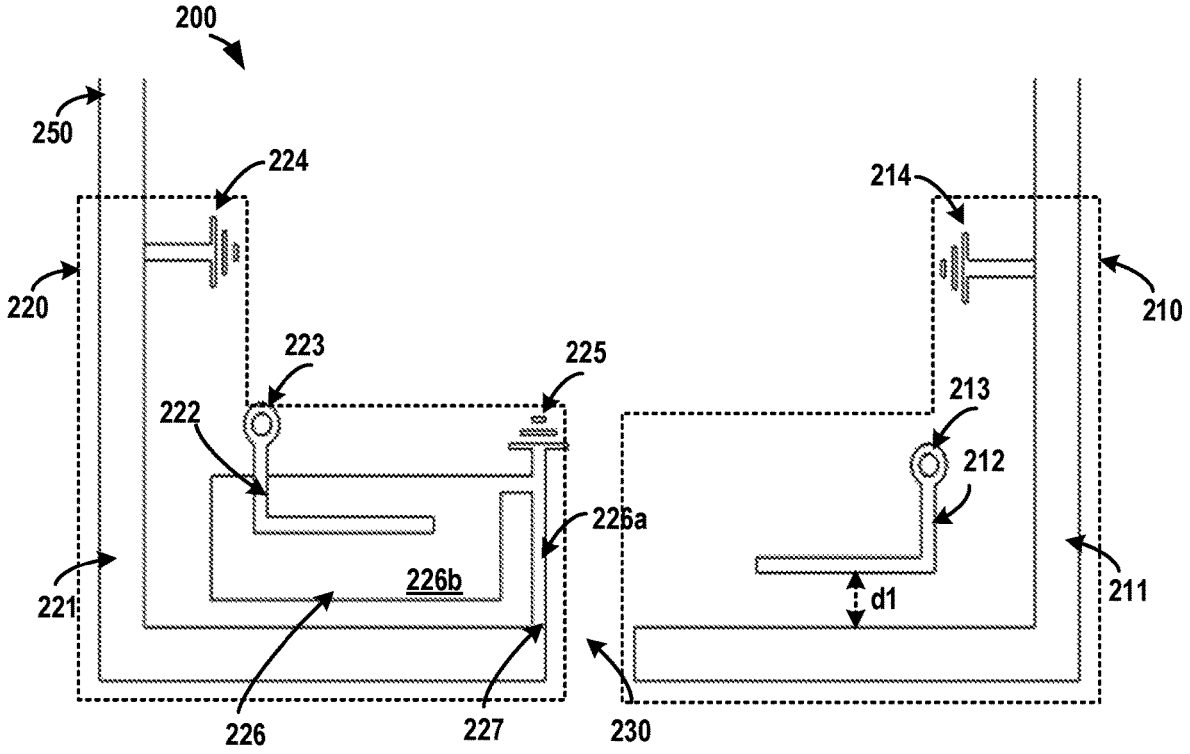
FIG. 2 illustrates a schematic diagram of an antenna arrangement for an electronic device in accordance with one implementation of the subject matter described herein are implemented.
Figure 3:
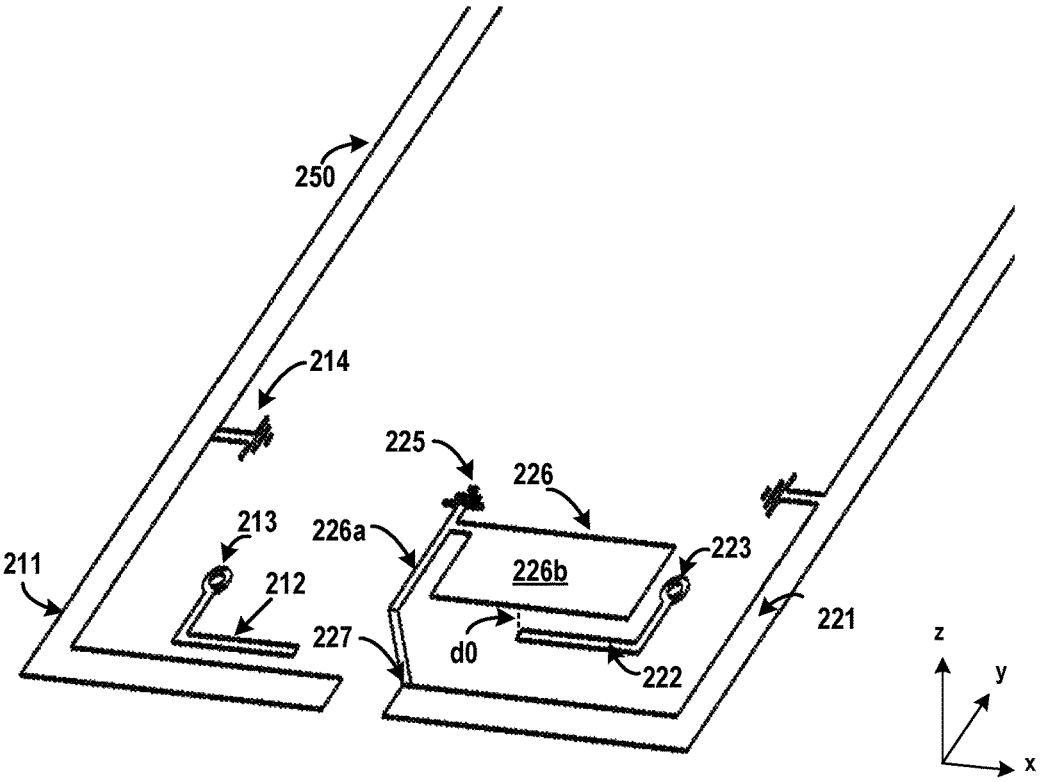
FIG. 3 illustrates another schematic diagram of an antenna arrangement for an electronic device in accordance with one implementation of the subject matter described herein.

FIGS. 2 and 3 respectively illustrate a schematic diagram of an antenna arrangement for an electronic device in a front view and another schematic diagram of the antenna arrangement in a back view in accordance with one implementation of the subject matter described herein. It shall be appreciated that a part of the electronic device such as a mobile phone is also shown to indicate an example arrangement of components of the antenna arrangement clearly; however it is shown only for illustration purposes, and it does not mean any limitation to the antenna arrangement.

As illustrated in FIG. 2, the antenna arrangement 200 comprises a first antenna 210 and a second antenna 220. The first antenna 210 may be for example a Long Term Evolvement (LTE) main antenna which could cover a bandwidth ranging from for example about 690 MHz to 3.6 GHz. The second antenna 220 may be for example a MIMO antenna or a non-cellar antenna. As an example of non-cellar antenna, the second antenna 220 may be an antenna for Global Positioning System (GPS), Wireless Local Area Network (WLAN), Bluetooth, radio broadcast, etc.

As illustrated in FIGS. 2 and 3, in the first antenna 210, a first metal section 211 is connected to a first grounding point 214, and a first initial radiator 212 is connected to a first antenna feeding point 213. The first initial radiator 212 is an initial radiator which generates first radiations and feeds them to the first metal section 211 via the first antenna feeding point 213. Thus, the first metal section 211 will function as another radiator to generate the first radiations together with the first initial radiator 212. The first metal section 211 is an integral part of a metal frame 250 of housing of the electronic device. The first metal section 211 can be also called as a metal ring, which may function as another radiator of the first antenna 210. Specially, the first metal section 211 and the first initial radiator 212 are separated by an air/substrate gap d1. In such a way, power of the first initial radiator 212 can be coupled to the first metal section 211 via proximity coupling, which will be detailed hereinafter.

Similarly, in the second antenna 220, a second metal section 221 is connected to a second grounding point 224, and a second initial radiator 222 is connected to a second antenna feeding point 223. The second initial radiator 222 is an initial radiator which generates second radiations and feeds them to the second metal section 221 via a second antenna feeding point 223. Thus, the second metal section 221 will function as another radiator to generate the second radiations together with the second initial radiator 222. The second metal section 221 is also an integral part of the metal frame 250 of the housing of the electronic device. Like the first metal section, the second metal section 221 can be also called as a metal ring and function as another radiator of the second antenna. Between the first metal section 211 and the second metal section 221, there is provided an opening 230.

The opening 230 may be an opening for recharging the electronic device, an opening for receiving an earphone plug, or etc., which separates the first metal section 211 and the second metal section 221. Particularly, the second metal section 221 is further connected to a third grounding point 225.

By further arranging such a grounding point 225 in addition to the second grounding point 224, it can provide isolation between the first antenna 210 and the second antenna 220. Thus, a pair of antennae can be built with the same one structure and at the same time a good antenna performance can be achieved. Theoretically, the grounding point 225 can be located anywhere so far as it can provide a predetermined level of isolation. In practice, it may be located at a position spaced from the second grounding point 224 by a certain distance to provide the desired isolation. In the illustrated antenna arrangement, the third grounding point 225 is located at an of the second metal section 221 end far away from the first grounding point 224 to provide the desired isolation.

The second metal section 221 can be electrically connected to the third grounding point 225 by any suitable means. In the example arrangement as illustrated in FIGS. 2 and 3, the second metal section 221 is electrically connected to the third grounding point 225 through a strip line 226*a*, particularly a straight microstrip line (having a length of 7 mm to 12 mm for mobile devices), printed on a printed circuit board (PCB) within the electronic device. Particularly, one of ends of the strip line 226 is electrically connected to the second metal section 221 at a connection point 227 and the other end of the strip line 226 is electrically connected to the third grounding point 225. Thus, the strip line 226 and the second metal section 221 can form a loop and the second metal section 221 is connected to the third grounding point 225 to provide the desired isolation.

Furthermore, there is a metal patch extension 226*b* extending from the strip line 226*a*, which is also printed in the PCB. The metal patch extension 226*b* is a metal patch which laterally extends from the strip line 226*a*. The metal patch extension 226 is about 5×10 $mm^2$ to 1×15 $mm^2$ and can form an antenna load. In such a way, it may reduce a demand on a length of the second metal section. Usually, to achieve an antenna arrangement with dual metal rings, it requires a predetermined metal ring length, for example 70 mm or even more and such a length will set limits on the miniaturization of the electronic device. However, in some implementations of the subject matter as described herein, the metal patch extension 226*b* functions as an antenna load for the second metal section 221 and thus a smaller length could also achieve the desired antenna arrangement. Thus, the original demand on the length of the second metal section could be reduced greatly. In other words, in such a case, the second metal section 221 may have a shorter length than the first metal section 211 by means of the metal patch extension 226*b*. For example, in one implementation of the subject matter as described herein, the second metal section 221 may be, for example, 10 mm shorter than the first metal section 211.

This length difference could provide more advantageous in antenna design. For example, if the first metal section 211 and the second metal section 221 are arranged near a top of a screen of the electronic device, the first metal section 211 may be arranged at the right top side while the second metal section 221 may be located on the left top side. This is because for a right-handed user, he/she will hold the electronic device at the left side with four fingers except his/her thumb and these fingers will cover more area and that at the right side. Thus, the shorter second metal section 221 will remarkably reduce a possibility that the antenna arranged is covered by those fingers. For a left-handed user, this arrangement can be reversed, i.e., the first metal section 211 may be located at the left top side and the second metal section 221 may be located at the right top side. For another case in which the first and second metal sections 211, 221 are arranged near a bottom of a screen of the electronic device, the antenna arrangement can also be arranged based on the length difference between the first metal section 211 and the second metal section 221. Therefore, it is clear that the length difference between the first metal section 211 and the second metal section 221 could provide additional benefits.

In addition, the metal patch extension 226*b* may also have another function, i.e., collecting power from the second initial radiator 222, which means the second initial radiator 222 could feed second radiations to the second metal section 221 through the metal patch extension 226*b*. Particularly, the power of the second initial radiator 222 is coupled to the metal patch extension 226*a* via the antenna feeding point 223 by means of aperture/proximity coupling and then the power is in turn delivered to a loop formed by the strip line 226*a* and the second metal section 221.

Figure 4:
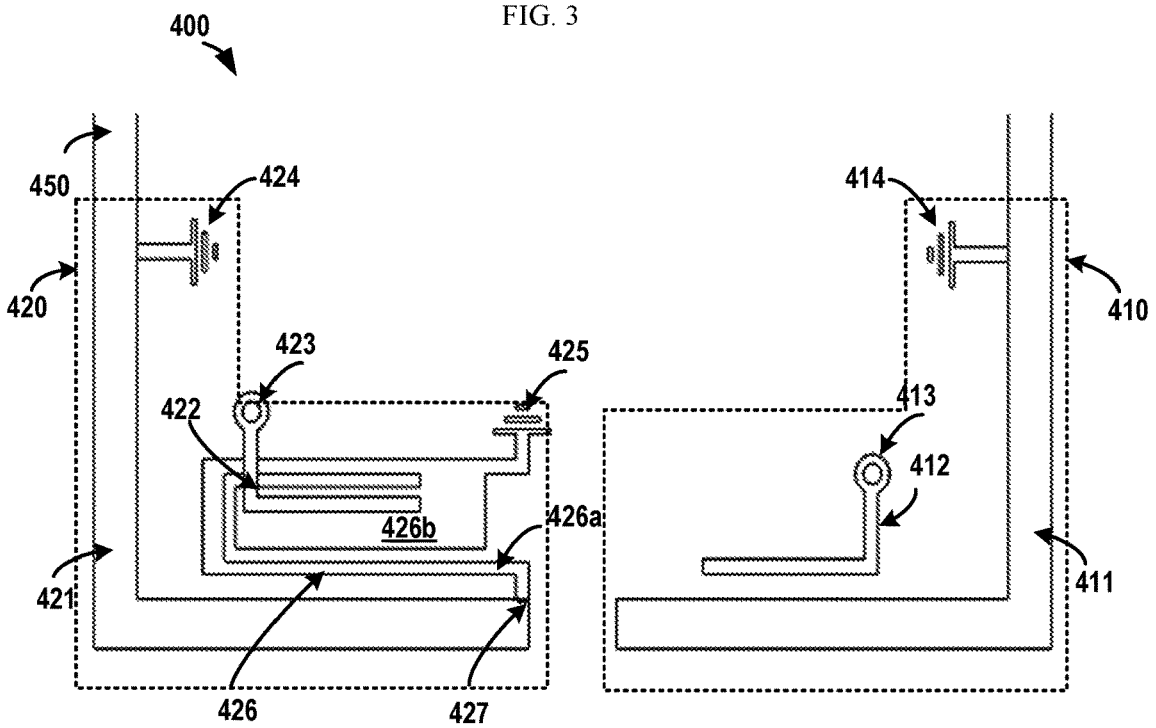
FIG. 4 illustrates a schematic diagram of another antenna arrangement for an electronic device in accordance with another implementation of the subject matter described herein.

FIG. 4 also illustrates a schematic diagram of another antenna arrangement for an electronic device in accordance with another implementation of the subject matter described herein. In FIG. 4, the first antenna 410, the second antenna 420 and relevant components including the first and second metal sections 411, 421, the first and second initial radiators 412, 422, the first and second feeding points 413, 423, the first and second grounding points 414, 424, the third grounding point 425 are identical to the first antenna 210, the second antenna 220 and those corresponding components as illustrated in FIGS. 2 and 3. The difference lies in that the antenna arrangement 400 has a strip line 426*a* and metal patch extension 426*b* which are different from the strip lines 226*a* and a metal patch extension 226*b* as illustrated in FIGS. 2 and 3. Specifically, the strip line 426*a* is not a straight microstrip line between the second metal section 421 and the third grounding point 425 but a microstrip line making a detour around the metal patch extension 426 which is connected with the strip line 426*a* near the grounding point. By this means, the length of the loop formed by strip line 426*a* and the second metal section 421 can be further increased.

Further as illustrated in FIGS. 2 and 3, the first initial radiator 212 and the second initial radiator 222 are printed on a PCB within the electronic device. In the existing antenna design with dual metal rings, an initial radiator is provided as separate components and connected to the circuit board with a supporting bracket. This needs not only an additional radiator production process but also an additional assembly process, which both means additional costs. However, through printing the first initial radiator 212 and the second initial radiator 222 on the PCB, the two initial radiators can be produced during the production of the PCB without any additional antenna producing process and additional assembling process. Thus, the production cost of the initial radiators can be reduced substantially and can be even called as zero-cost. The first initial radiator 212 and the second initial radiator 222 may be for example strip lines printed on the PCB. As illustrated in FIGS. 2 and 3, the first metal section 212 and the second metal section 222 are both microstrip lines in an L-shape and can be printed on the same surface of the PCB (i.e., they are coplanar). The first initial radiator 212 and the second initial radiator 222 may have an area ranging from 1×20 $mm^2$ to 1×40 $mm^2$. In one implementation of the subject matter as described herein, the size of the first and second initial radiator is about 1×21 $mm^2$, which is several times smaller than the regular initial radiator. Therefore, such a design may facilitate the miniaturization of the electronic device.

The second initial radiator 222 and the metal patch extension 226*b* are not in coplanar with each other, which means that they can be printed on different surfaces of the printed circuit board. In other words, there is an air/substrate gap d0 between them in z direction as illustrated. It can be understood that the metal patch extension 226*b* which is also printed on the PCB will cover a certain area of the PCB. Thus, due to the limited area, it is not easy to arrange the second initial radiator 222 at the same surface as the metal patch extension 226*b*. Thus, as illustrated in FIG. 3, the second initial radiator 222 and the metal patch extension 226*b* are printed on different surfaces of the PCB. For example, the second initial radiator 222 may be located on the top surface of the PCB together with the first initial radiator 212, while the grounding connection 226 comprising the metal patch extension 226*b* may be located the bottom surface of the PCB. In such a case, the coupling between the second initial radiator 222 and the second metal section 226*b* could be obtained by means of an aperture coupling as illustrated in FIG. 3 instead of a conventional direct connection. In other word, an aperture which goes through the PCB will be provided between the antenna feeding point 223 and the metal patch extension 226*b*. By utilizing the aperture coupling, it is possible to provide a desired coupling between the second metal section 221 and the second initial radiator 222 without using any physical feeding connection or using any feeding clips. In addition, the use of non-contact coupling will provide additional merits of reducing the required length of the second metal section. For example, in an implementation, the second metal section 221 may have a length of 50 mm, or even 40 mm long. In addition, the coupling between the second initial radiator and the metal patch extension may also be implemented by proximity coupling to achieve similar effects.

For the coupling between the first metal section and the first initial radiator, it is possible to obtain the coupling in many ways, for example, by a direct connection. However, in one implementation of the subject matter as described herein, it can be provided by a slot or proximity coupling. As illustrated in FIGS. 2 and 3, the first initial radiator 212 is printed on the PCB near the inner edge of a display chassis to provide a good proximity coupling. The gap d1 between the PCB and the display chassis can range from, for example, 1.5 mm to 2.55 mm, and particularly can be 2 mm for example. By this means, it can achieve the desired coupling between the first metal section 211 and the first initial radiator 212 without any physical feed connection or feeding clips. Moreover, similarly, the use of non-contact coupling will provide an additional merit of reducing the required length of the first metal section. In an implementation, the first metal section 211 may have a length of 60 mm or even 50 mm.

Figure 5:
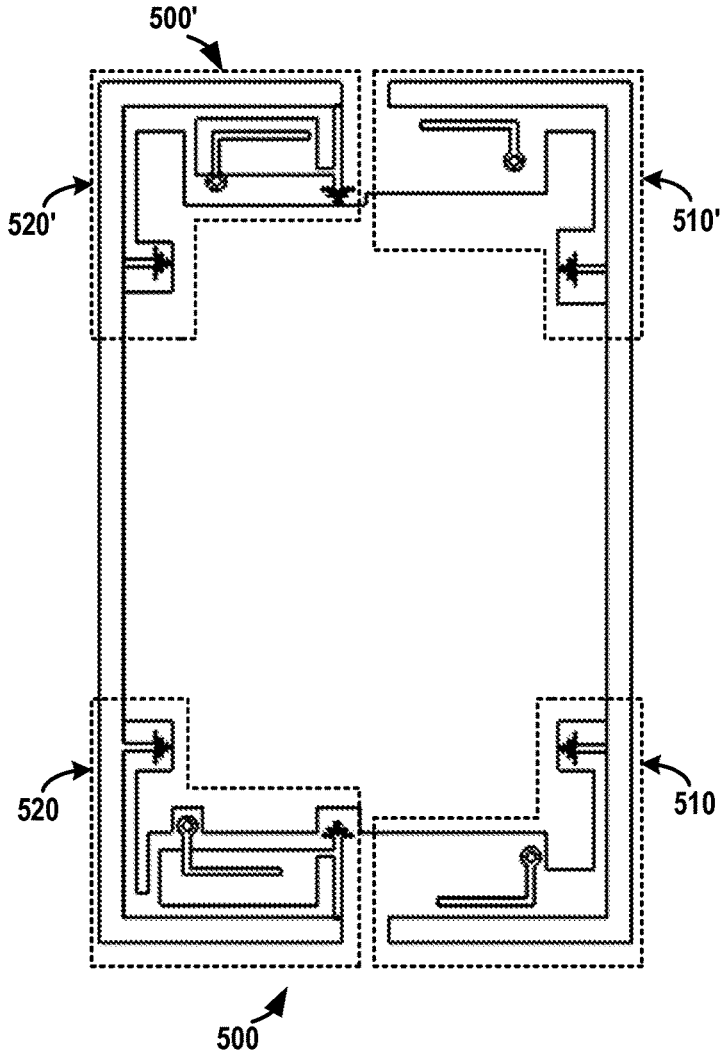
FIG. 5 illustrates a schematic diagram of an electronic device containing antenna arrangements in accordance with one implementation of the subject matter described herein.

The antenna arrangement as illustrated in FIGS. 2 to 4 can be included in an electronic device such as mobile devices. For illustration purposes, FIG. 5 illustrates a schematic diagram of an electronic device containing antenna arrangements in accordance with one implementation of the subject matter described herein. As illustrated in FIG. 5, the electronic device may comprise two antenna arrangements 500 and 500' which are respectively arranged on the top and the bottom of display screen. The antenna arrangement 500 comprises a first antenna 510 and a second antenna 520 and the antenna arrangement 500' comprises a first antenna 510' and a second antenna 520. The first antennae 510 and 510' have a similar structure to the first antenna 210, 410 illustrated in FIGS. 2 to 3 or FIG. 4 and the second antennae 520 and 520' have a similar structure to the second antenna 220, 420 as illustrated in FIGS. 2 to 3 or FIG. 4. However, it shall be understood that although the electronic device is illustrated as including two antenna arrangements, it may also contain only one antenna arrangement or more than two.

It shall be understood that for an antenna arrangement, it is tough to meet the low band requirement when a 4G system is required in an electronic device such as mobile phone. The reason lies in that the antenna arrangement has to meet not only B5 & B8 requirements for 2G and 3G systems but also B17, B13 and B20 (from 699 to 960 MHz) requirements. Usually, there is a big challenge for an antenna arrangement to cover such a wide bandwidth. In order to tackle this, a tuner or a single-pole-four-throw switcher (SP4T) can be used, which could provide different matching topologies to tune antenna resonant frequency, which might range from 690 MHz to 3.6 GHz for example. Hereinafter, several different matchings are described only for illustration purposes.

Figure 6A:
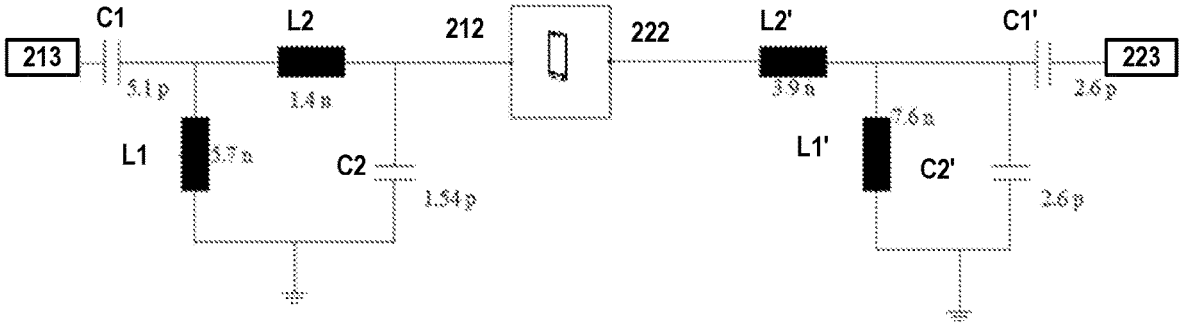
FIGS. 6A to 6D illustrate an example matching for an antenna arrangement and corresponding S-parameter and antenna efficiency in accordance with one implementation of the subject matter described herein.
Figure 6B:
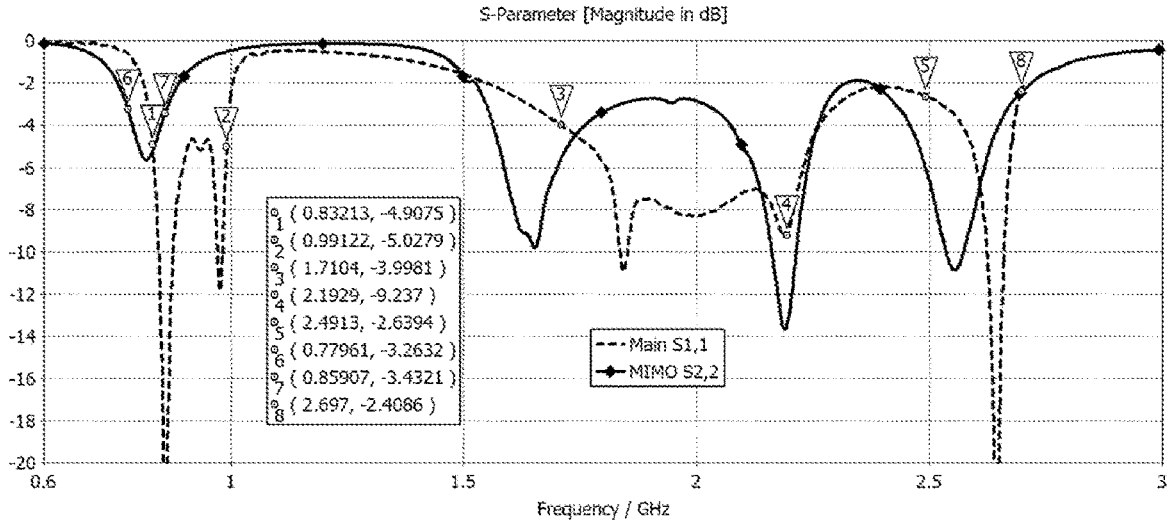
Figure 6C:
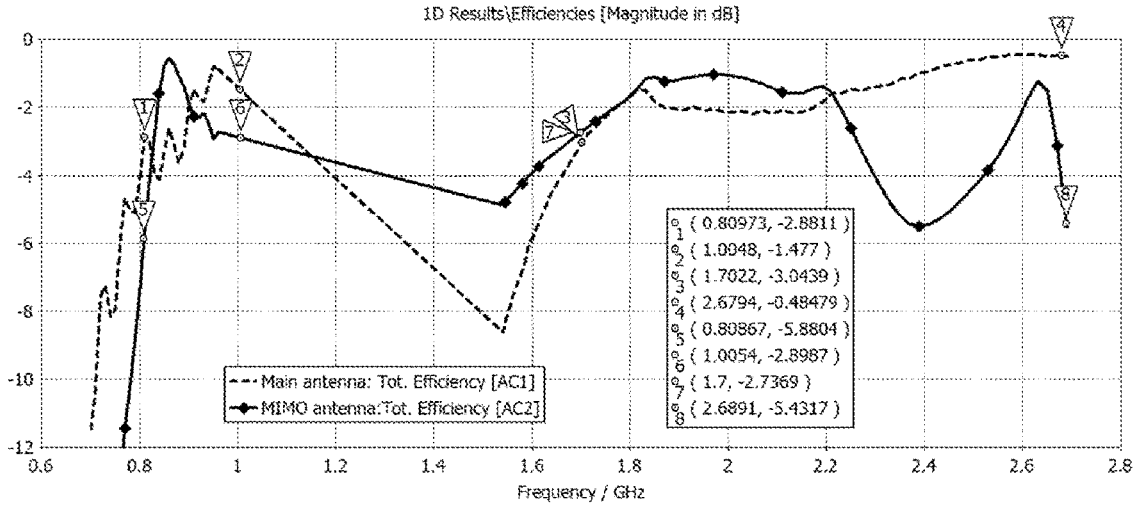

FIG. 6A illustrates an example matching for the antenna arrangement in accordance with one implementation of the subject matter described herein. As illustrated in FIG. 6A, the electronic device such as a mobile phone has matching circuits between the first feeding point 213 and the first initial radiator 212 and between the second feeding point 223 and the second initial radiator 222 for both the main antenna and the MIMO antenna. In each matching circuit, 4 lumped elements are used, including two capacitors C1 and C2 or C1' and C2' and two inductors L1 and L2 or L1' and L2' which are connected as illustrated in FIG. 6A. FIG. 6B and 6C illustrate a corresponding S-parameter and antenna efficiency for the matching circuits as illustrated in FIG. 6A. The curves as illustrated in FIG. 6B and 6C are obtained through a simulation based on the parameter values as shown in FIG. 6A. From the S-parameter curves, it can be seen that with those matching circuits, the main antenna may cover both B5 & B8 with 200 MHz bandwidth (800-1000 MHz), and LTE middle and high bands (about 1710-2690 MHz). Besides, the antenna efficiency curves show that at the low band, the antenna efficiency is about −3.0 dB; at the middle & high bands ranging from 1.71 to 2.7 GHz, it is over −3 dB. At the same time, the MIMO antenna also achieved a good matching and radiation efficiency. At the low band, its bandwidth is about 200 MHz, ranging from 800 MHz to 1000 MHz, and at the high band it can cover a bandwidth from 1710 MHz to 2690 MHz. As the MIMO antenna can allow a 3 dB degradation in comparison to main antenna, its radiation efficiency could meet over −6 dB target in both frequency ranges, i.e., 800 MHz-1000 MHz and 1710 MHz to 2170 MHz, as shown in FIG. 6C.

Figure 6D:
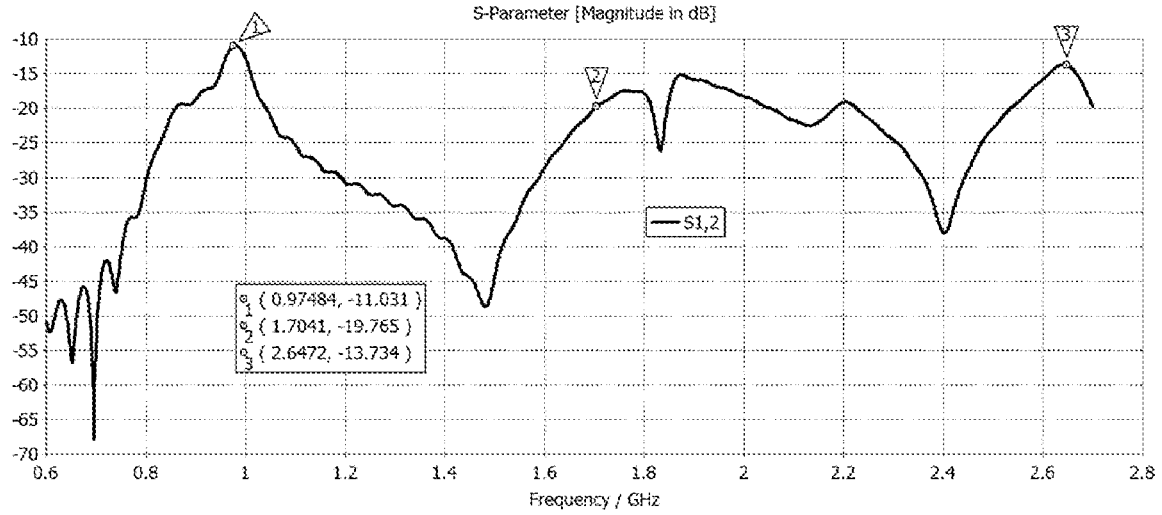

As shown in FIG. 2, the opening 230 is small in practice, about 10 mm or less. As two antennae for example, the main antenna and the MIMO antenna, are arranged with such a close distance, they will have very poor isolation not to meet certification standard. However, FIG. 6D illustrates a good isolation between main and MIMO antennas for the FIG. 6A case. Two antennas achieve −11 dB isolation to meet RF requirements.

Figure 7A:
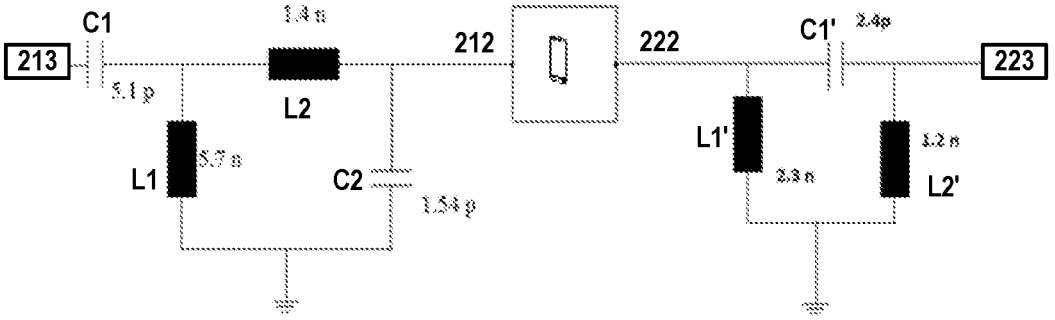
FIGS. 7A to 7C illustrate another example matching for an antenna arrangement and corresponding S-parameter and antenna efficiency in accordance with another implementation of the subject matter described herein.
Figure 7B:
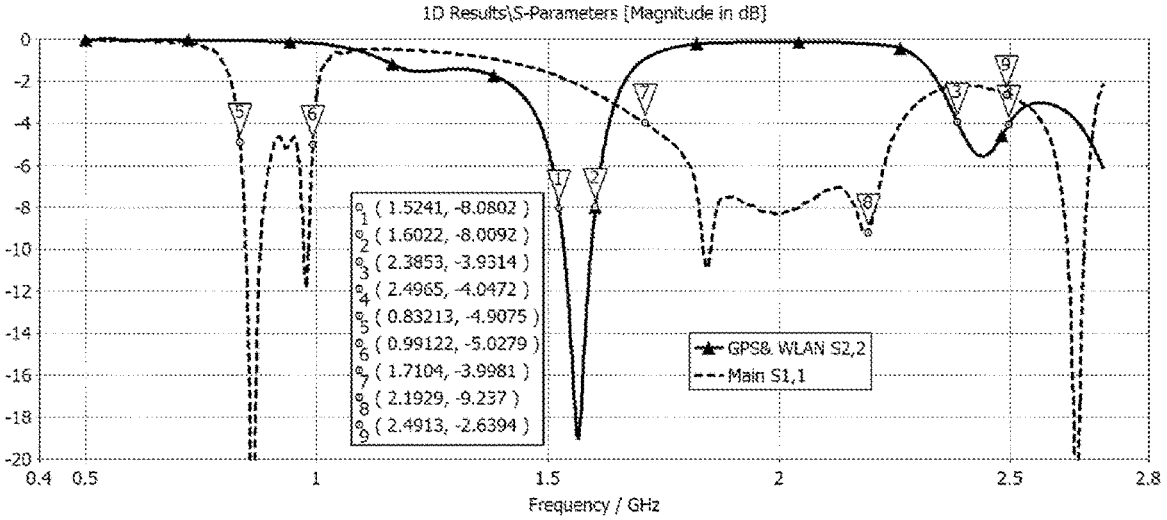
Figure 7C:
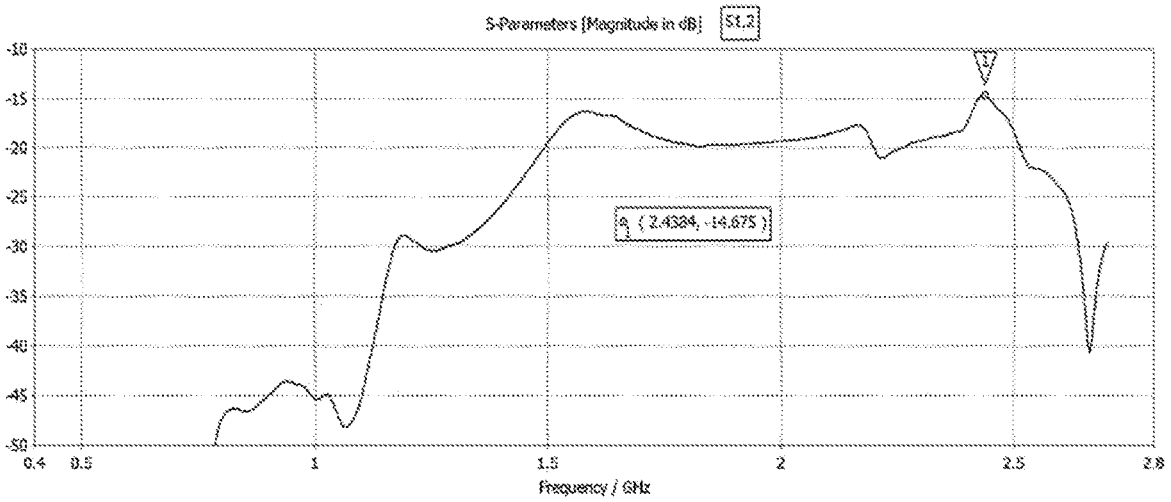

FIG. 7A shows another matching for the antenna arrangement and corresponding S-parameter and antenna efficiency in accordance with another implementation of the subject matter described herein. Different from FIG. 6A, in FIG. 7A, the second antenna's matching circuit is changed so that the antenna can function as a GPS & WLAN combo antenna. Particularly, the matching circuit uses two inductors L1' and L2' and one capacitor C1'. Thus, it may have two resonances around 1.57 GHz and 2.4 GHz. From curves as illustrated in FIGS. 7B and 7C, it can be seen that with these matching circuits, the antenna pairs can both cover desired frequency bands and obtain a good isolation (below −15 dB) therebetween.

Although the specific matchings are described hereinbefore with reference to FIG. 6A to 7C; the subject matter as described herein is not limited thereto. In a real application, it may include tens or more of matching circuits with different parameters setting, which might enable the antenna arrangement to cover different frequency bandwidths, even covering from 690 MHz to 3.6 GHz.

In addition, there is also provided a solution for manufacturing an antenna arrangement for an electronic device, which will be described in detail with reference FIG. 8.

Figure 8:
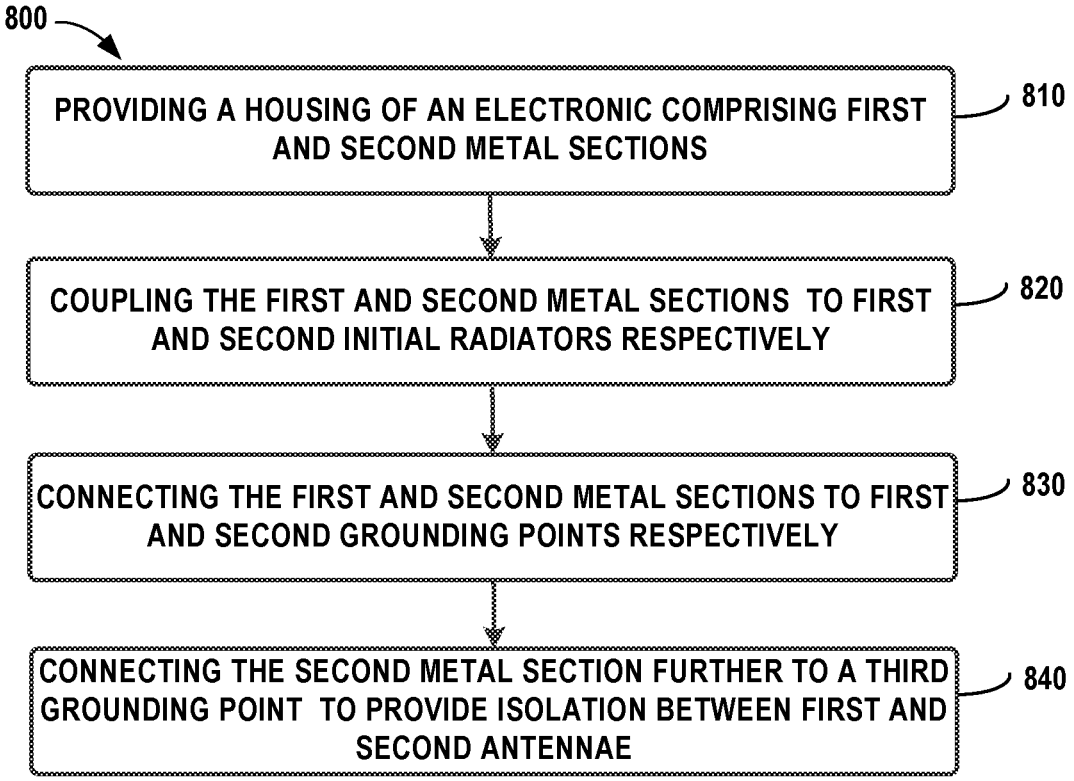
FIG. 8 schematically illustrates a flow chart of a method of manufacturing an antenna arrangement for an electronic device in accordance with one implementation of the subject matter described herein.

FIG. 8 illustrates a method of manufacturing an antenna arrangement for an electronic device in accordance with one implementation of the subject matter as described herein. As illustrated in FIG. 8, the method starts from step 810, in which a housing of electronic device is provided. The housing may comprise a first metal section and a second metal section, which are integral parts of the housing and separated by an opening. In one implementation of the subject matter as described herein, the first metal section and the second metal section may be both parts of metal frame of the housing of the electronic device.

Then in step 820, the first metal section and the second metal section are coupled to a first initial radiator and a second initial radiator respectively. The first metal section and the second metal section can be coupled to the first initial radiator and the second radiation in any suitable manner. Particularly, in one implementation of the subject matter as described herein, the coupling between the first metal section and the first initial radiator can be implemented via a proximity coupling, while the coupling between the second initial radiator and the second metal section may be implemented via an aperture/proximity coupling. Thus, the first metal section and the second metal sections can be made shorter.

In step 830, the first metal section and the second metal section are connected to a first grounding point and a second grounding point respectively. The first grounding point and the second grounding point may be located at two opposite ends of the first and second metal sections, which are far away from each other. The couplings may be implemented by using two grounding clips.

Further, in step 840, the second metal section is further connected to a third grounding point to provide isolation between a first antenna and a second antenna to be formed. The first antenna may comprise the first metal section and the first initial radiator, and the second antenna may comprise the second metal section and the second initial radiator. In one implementation of the subject matter as described herein, the third grounding point may be located at an end of the second metal section away from the second ground point so as to provide the desired isolation.

In one implementation of the subject matter as described herein, the method may further comprise providing a printed circuit board having a strip line printed thereon. The second metal section may be connected to the third grounding point through the strip line. On the PCB board, there is further printed a metal patch extension extending from the strip line. This metal patch extension may function as an antenna load, which will help to reduce a demand on a length of the second metal section. The second initial radiator may feed radiations to the second metal section through the metal patch extension. That is to say, the metal patch extension will collect power from the second initial radiator and feeds the power to the second metal section.

In an implementation of the subject matter as described herein, the stripe line may be a straight line between the third grounding point and the second metal section as illustrated in FIGS. 2 and 3. In another implementation of the subject matter as described herein, the strip line may also be a line making a detour around the metal patch extension as illustrated in FIG. 4. In addition, at least one of the first initial radiator and the second initial radiator can be printed on the printed circuit board. Instead of manufacturing the first and/or the second initial radiators in a separate process, they will be printed on the PCB, during the production of the PCB, which will provide a low-cost advantage. For example, the at least one of the first initial radiator and the second initial radiator is a strip line printed on the printed circuit board and has an area ranging from $1\times20$ mm$^2$ to $1\times40$ mm$^2$. Moreover, the second initial radiator and the metal patch extension may be printed on different surfaces of the printed circuit board, which might provide a feasible and space saving antenna arrangement.

In one implementation of the subject matter as described, the first metal section is about 50 mm long and the second metal section is about 40 mm long. The first antenna may be a LTE main antenna which covers a bandwidth ranging from 690 MHz to 3.6 GHz, while the second antenna is an MIMO antenna or a non-cellular antenna.

In addition, in the subject matter described herein, there is also provided an electronic device comprising an antenna arrangement as described hereinbefore with reference to FIGS. 2 to 7C. For a purpose of simplification, the detailed description of the electronic device will be not be elaborated herein, for details about these actions, reference may be made to the description with reference to FIGS. 2 to 7C.

Hereinbefore, specific implementations of the subject matter as described herein have been described in detail; however, it should be appreciated that all of these implementations are presented only for illustration purpose and the subject matter as described herein are not limited thereto. In fact, from the teachings provided herein, the skilled in the art will conceive of various modifications or variations without departing the spirit of the subject matter described herein. For example, in implementations of the subject matter as descried herein, the first and second metal sections are described as integral parts of the metal frame of an electronic device; however the subject matter as described herein is not limited to this and is also possible to use other parts of the housing as the first and second metal sections, for example located on the backside of the electronic device. Besides, it is also possible to reverse functionalities of the first and second antennae 210 and 220; the first metal section may also use an aperture coupling and use the metal patch extension to reduce its length, just as proposed for the second metal section. The first initial radiator and the second initial radiator may be printed on different surface of the PCB and at the same time the first initial radiator and the metal patch extension can be printed on the same surface of the PCB. In addition, shapes of the first and second initial radiators can be different from that illustrated in FIGS. 2 to 4 and the shape of the first initial radiator and the shape of the second initial radiator can be different from each other. Furthermore, the order of performing methods 800 can be changed unless the changing is forbidden due to attributes of steps. For example, step 820, 830 and 840 can be performed in an order different from that described with reference to FIG. 8 since there is no need to set strict orders for them. It should be appreciated that all these modifications or variations should be included within the scope of the subject matter described herein and the scope of the subject matter described herein is only defined by the claims appended hereinafter.

For illustrative purposes, some example implementations of the subject matter described herein are listed below.

In one aspect, there is provided an antenna arrangement for an electronic device. The antenna arrangement comprises a first antenna with a first metal section connected to a first grounding point and a first initial radiator for feeding first radiations to the first metal section; and a second antenna with a second metal section connected to a second grounding point and a second initial radiator for feeding second radiations to the second metal section, wherein the first metal section and the second metal section are integral parts of a housing of the electronic device and separated by an opening, and wherein the second metal section is further connected to a third grounding point to provide isolation between the first antenna and the second antenna.

In one implementation, the third grounding point is located at an end of the second metal section away from the second grounding point.

In another implementation, the second metal section is coupled to the third grounding point through a strip line printed on a printed circuit board within the electronic device, and wherein a metal patch extension extends from the strip line to reduce a demand on a length of the second metal section.

In a further implementation, the second initial radiator feeds the second radiations to the second metal section through the metal patch extension.

In a still further implementation, the stripe line is a straight line between the third grounding point and the second metal section or a line making a detour around the metal patch extension.

In a yet further implementation, at least one of the first initial radiator and the second initial radiator is printed on the printed circuit board within the electronic device.

In one implementation, the second initial radiator and the metal patch extension are printed on different surfaces of the printed circuit board.

In another implementation, the first initial radiator is coupled to the first metal section via a proximity coupling, and/or wherein the second initial radiator is coupled to the second metal section via an aperture or proximity coupling.

In a further implementation, at least one of the first initial radiator and the second initial radiator is a strip line printed on the PCB and has an area ranging from 1×20 mm2 to 1×40 mm2.

In a still further implementation, the first metal section and the second metal section are parts of a metal frame of the housing of the electronic device, wherein the first metal section is about 40 mm long and the second metal section is about 50 mm long.

In a yet further implementation, the first antenna is a Long Term Evolvement (LTE) main antenna which covers a bandwidth ranging from 690 MHz to 3.6 GHz and wherein the second antenna is a Multiple-Input Multiple-Output (MIMO) antenna or a non-cellular antenna.

In another aspect, there is provided an electronic device comprising at least one antenna arrangement according to the one aspect as described immediately above.

In a further aspect, there is further provided a method of manufacturing an antenna arrangement for an electronic device. The method comprises: providing a housing of an electronic device, the housing comprising a first metal section and a second metal section which are integral parts of the housing and separated by an opening; coupling the first metal section and the second metal section to a first initial radiator and a second initial radiator respectively; connecting the first metal section and the second metal section to a first grounding point and a second grounding point respectively; and connecting the second metal section further to a third grounding point to provide isolation between a first antenna comprising the first metal section and the first initial radiator and a second antenna comprising the second metal section and the second initial radiator.

In one implementation, the third grounding point is located at an end of the second metal section away from the second grounding point.

In another implementation, the method further comprise: providing a printed circuit board having a strip line and a metal patch extension printed thereon, wherein the second metal section is connected to the third grounding point through the strip line, and wherein the metal patch extension extends from the strip line to reduce a demand on a length of the second metal section.

In a further implementation, the second initial radiator feeds radiations to the second metal section through the metal patch extension.

In a still further implementation, the stripe line is a straight line between the third grounding point and the second metal section or is a line making a detour around the metal patch extension.

In a yet further implementation, at least one of the first initial radiator and the second initial radiator is printed on the printed circuit board within the electronic device.

In one implementation, the second initial radiator and the metal patch extension are printed on different surfaces of the printed circuit board.

In another implementation, the first initial radiator is coupled to the first metal section via a proximity coupling, and/or wherein the second initial radiator is coupled to the second metal section via an aperture or proximity coupling.

In a further implementation, at least one of the first initial radiator and the second initial radiator is a strip line printed on the PCB and has an area ranging from 1×20 mm2 to 1×40 mm2.

In a still further implementation, the first metal section and the second metal section are parts of a metal frame of the housing of the electronic device, wherein the first metal section is about 40 mm long and the second metal section is about 40 mm long.

In a yet further implementation, the first antenna is a Long Term Evolvement (LTE) main antenna which covers a bandwidth ranging from 690 MHz to 3.6 GHz and wherein the second antenna is a Multiple-Input Multiple-Output (MIMO) antenna or a non-cellular antenna.

Further, while operations are depicted in a particular order, this should not be understood as requiring that such operations be performed in the particular order shown or in sequential order, or that all illustrated operations be performed, to achieve desirable results. In certain circumstances, multitasking and parallel processing may be advantageous. Likewise, while several specific implementation details are contained in the above discussions, these should not be construed as limitations on the scope of the subject matter described herein, but rather as descriptions of features that may be specific to particular implementations. Certain features that are described in the context of separate implementations may also be implemented in combination in a single implementation. Conversely, various features that are described in the context of a single implementation may also be implemented in multiple implementations separately or in any suitable sub-combination.

Although the subject matter has been described in language specific to structural features and/or methodological acts, it is to be understood that the subject matter defined in the appended claims is not necessarily limited to the specific features or acts described above. Rather, the specific features and acts described above are disclosed as example forms of implementing the claims.

What is claimed is:

1. An electronic device, comprising:

a housing; and an antenna arrangement implemented within the housing, the antenna arrangement comprising:

a first antenna having a first metal section integrated within the housing and a first initial radiator for feeding first radiations to the first metal section, wherein the first antenna is connected to a first grounding point;

a second antenna having a second metal section integrated within the housing and a second initial radiator for feeding radiation to the second metal section; and a metal patch extension printed on a printed circuit board of the electronic device and connected to the second antenna via a strip line printed on the printed circuit board.

2. The electronic device of claim 1, wherein a length of the second metal section is shorter than a length of the first metal section based on a size of the metal patch extension.

3. The electronic device of claim 2, wherein the length of the second metal section is at least 10 mm shorter than the length of the first metal section based on one or more dimensions of the metal patch extension.

4. The electronic device of claim 1, wherein the second antenna has a first end and a second end opposite the first end of the second metal section, wherein the second grounding point is positioned on the first end, and wherein the second antenna further comprises a third grounding point positioned at the second end opposite the first end.

5. The electronic device of claim 4, wherein the second metal section has an L-shape microstrip line around a perimeter of the housing, wherein the second grounding point is positioned at a first end of the L-shape microstrip line corresponding to the first end of the second metal section and the third grounding point is positioned at a second end of the L-shape microstrip line corresponding to the second end of the second metal section.

6. The electronic device of claim 1, wherein the strip line comprises a 7 to 12 mm strip line printed on the printed circuit board.

7. The electronic device of claim 1, wherein the electronic device is a mobile phone.

8. The electronic device of claim 7, wherein the first antenna is a Long Term Evolution (LTE) main antenna which covers a bandwidth ranging from 690 MHz to 3.6 GHz and wherein the second antenna is a Multiple-Input Multiple-Output (MIMO) antenna or a non-cellular antenna.

9. The electronic device of claim 1, wherein the metal patch extension includes a 5×10 $mm^2$ to 10×15 $mm^2$ patch on the printed circuit board.

10. The electronic device of claim 1, wherein the second initial radiator feeds the second initial radiations to the second metal section through the metal patch extension.

11. The electronic device of claim 1, wherein the strip line is a straight strip line between a third grounding point on the second antenna and the second metal section or a non-straight strip line routed around the metal patch extension.

12. The electronic device of claim 1, wherein at least one of the first initial radiator and the second initial radiator is printed on the printed circuit board within the electronic device.

13. The electronic device of claim 1, wherein the second initial radiator and the metal patch extension are printed on different surfaces of the printed circuit board.

14. The electronic device of claim 1, wherein at least one of the first initial radiator and the second initial radiator are printed on the printed circuit board and have an area ranging from 1×20 $mm^2$ to 1×40 $mm^2$.

15. The electronic device of claim 1, wherein the first metal section and the second metal section are parts of a metal frame of the housing of the electronic device, wherein the first metal section is about 50 mm long and the second metal section is about 40 mm long.

16. The electronic device of claim 1, wherein the first antenna and the second antenna are separated by an opening to provide isolation between the first antenna and the second antenna.

17. A method of manufacturing an antenna arrangement for an electronic device, comprising:

a housing of the electronic device, the housing comprising a first metal section and a second metal section which are integral parts of the housing;

coupling the first metal section and the second metal section to a first initial radiator and a second initial radiator respectively;

connecting the first metal section and the second metal section to a first grounding point and a second grounding point respectively; and providing a printed circuit board having a strip line and a metal patch extension printed thereon, wherein the second metal section is connected to the metal patch extension via the strip line.

18. The method of claim 17, wherein the second metal section is shorter than the first metal section based on a reduced demand on a length of the second metal section based on the metal patch extension extending from the strip line.

19. The method of claim 17, wherein the second metal section is at least 10 mm shorter than the first metal section based on one or more dimensions of the metal patch extension.

20. The method of claim 17, wherein the metal patch extension is coupled to the second metal section to act as an antenna load for the second metal section.

* * * * *